US009145643B2

(12) United States Patent
Inoue et al.

(10) Patent No.: US 9,145,643 B2
(45) Date of Patent: Sep. 29, 2015

(54) WET PAPER WEB TRANSFER BELT, PAPERMAKING SYSTEM, PAPERMAKING METHOD AND DESIGN METHOD OF A PAPERMAKING SYSTEM

(71) Applicant: Ichikawa Co., Ltd., Bunkyo-ku (JP)

(72) Inventors: Kenji Inoue, Tokyo (JP); Masatoshi Kono, Tokyo (JP); Ryo Umehara, Tokyo (JP); Ai Tamura, Tokyo (JP); Toshihiro Tsuji, Tokyo (JP)

(73) Assignee: ICHIKAWA CO., LTD., Bunkyo-ku (JP)

( * ) Notice: Subject to any disclaimer, the term of this patent is extended or adjusted under 35 U.S.C. 154(b) by 0 days.

(21) Appl. No.: 14/032,783

(22) Filed: Sep. 20, 2013

(65) Prior Publication Data

US 2014/0076510 A1 Mar. 20, 2014

(30) Foreign Application Priority Data

Sep. 20, 2012 (JP) ..... 2012-206801

(51) Int. Cl.

| | |
|---|---|
| ***D21F 2/00*** | (2006.01) |
| ***D21F 1/66*** | (2006.01) |
| ***D21F 7/08*** | (2006.01) |
| ***D21F 3/02*** | (2006.01) |

(52) U.S. Cl.

CPC .. *D21F 1/66* (2013.01); *D21F 2/00* (2013.01); *D21F 3/029* (2013.01); *D21F 7/086* (2013.01)

(58) Field of Classification Search

CPC ... D21F 1/0027; D21F 1/0036; D21F 1/0054; D21F 1/0063; D21F 1/10; D21F 1/105; D21F 2/00; D21F 3/02; D21F 3/029; D21F 3/04; D21F 7/08; D21F 7/083; D21F 7/086; D21F 7/10; D21F 7/12; D21F 1/66

USPC ..... 162/306, 358.1, 358.2, 358.4, 348, 361, 162/362, 900–904

See application file for complete search history.

(56) References Cited

U.S. PATENT DOCUMENTS

| | | | | |
|---|---|---|---|---|
| 5,298,124 | A * | 3/1994 | Eklund et al. | 162/306 |
| 5,601,877 | A * | 2/1997 | Miller et al. | 427/373 |
| 6,306,260 | B1 * | 10/2001 | Kawashima | 162/306 |

(Continued)

FOREIGN PATENT DOCUMENTS

| | | | |
|---|---|---|---|
| EP | 0 576 115 | A1 | 12/1993 |
| EP | 2 581 493 | A1 | 4/2013 |
| JP | 06-57678 | A | 3/1994 |
| WO | WO 2008/131979 | * | 11/2008 |

OTHER PUBLICATIONS

U.S. Appl. No. 14/033,099, filed Sep. 20, 2013, Inoue, et al.

(Continued)

*Primary Examiner* — Eric Hug

(74) *Attorney, Agent, or Firm* — Oblon, McClelland, Maier & Neustadt, L.L.P.

(57) ABSTRACT

A wet paper web transfer belt for transferring a wet paper web includes a wet paper web contacting surface for carrying the wet paper web. The wet paper web contacting surface is constituted by a resin layer, and the wet paper web contacting surface includes a wet paper web carrying region for carrying the wet paper web. A prescribed relation of the swelling rate in water of the resin layer and the surface roughness of the wet paper web contacting surface is fulfilled in accordance with the basis weight of the base paper of the wet paper web.

12 Claims, 5 Drawing Sheets

(56) References Cited

U.S. PATENT DOCUMENTS

| | | | | |
|---|---|---|---|---|
| 6,605,188 | B2 * | 8/2003 | Hagfors et al. | 162/306 |
| 7,128,811 | B2 * | 10/2006 | Watanabe | 162/358.4 |
| 7,811,418 | B2 * | 10/2010 | Klerelid et al. | 162/358.2 |
| 8,025,771 | B2 * | 9/2011 | Ouchi et al. | 162/358.2 |
| 2007/0074836 | A1 | 4/2007 | Westerkamp | |
| 2011/0127000 | A1 * | 6/2011 | Yazaki et al. | 162/289 |
| 2013/0092339 | A1 | 4/2013 | Inoue et al. | |

OTHER PUBLICATIONS

Extended European Search Report issued Oct. 29, 2013, in Patent Application No. 13185099.2.
U.S. Appl. No. 14/608,629, filed Jan. 29, 2015, Inoue, et al.
U.S. Appl. No. 14/608,660, filed Jan. 29, 2015, Inoue, et al.

* cited by examiner

WET PAPER WEB TRANSFER BELT, PAPERMAKING SYSTEM, PAPERMAKING METHOD AND DESIGN METHOD OF A PAPERMAKING SYSTEM

TECHNICAL FIELD

The instant application relates to a wet paper web transfer belt, papermaking system, papermaking method, and design method of a papermaking system.

BACKGROUND ART

Papermaking machines for removing moisture from the source material of paper are generally equipped with a wire part, a press part and a dryer part. These parts are arranged in the order of wire part, press part and dryer part in the wet paper web transfer direction.

In one type of papermaking machine, the wet paper web is passed from one part to another in an open-draw. In the press part of this open-draw papermaking machine, there are a number of places in which the wet paper web is not supported by any roll or by papermaking equipment such as a felt or a belt; in other words, places in which the wet paper web is traveling on its own. In these places, problems such as "web breaks" tend to occur. The risk of these problems occurring increases as the papermaking machine is operated at higher speeds. Therefore, there are limitations to operating an open-draw papermaking machine at high speeds.

In recent years, most papermaking machines have been of the type in which the wet paper web is passed in a closed-draw. In the press part of this closed-draw papermaking machine, the wet paper web is transferred while being placed on a papermaking felt or wet paper web transfer belt. Therefore, there are no places in which the wet paper web travels on its own as in the open-draw papermaking machine. As a result, it has become possible to operate papermaking machines at even higher speeds and to stabilize operations.

Incidentally, in the press part of such a closed-draw papermaking machine, the so-called "paper robbing" phenomenon may occur, in which the wet paper web gets stuck at a belt or a felt when it is passed between the belts or felts and is not passed to the next belt or felt to which it ought to be passed. In conventional machines, when the "paper robbing" phenomenon occurs, it is necessary to temporarily stop the papermaking operation and to change the setting of the device so that the wet paper web is properly passed.

A number of studies have been made for improving the wet paper web transfer properties in the press part.

JP 06-057678 teaches a wet paper web transfer belt, in which a wet paper web contacting surface formed on the upper surface of a base (wet paper web side) is formed by an impermeable polymer coating layer and a lower surface of the base (roll side) is formed by a fibrous web. Particles with a higher hardness than the polymer coating are mixed in the impermeable polymer coating layer and the particles are made to protrude from the surface by such means as polishing the wet paper web contacting surface.

Moreover, the wet paper web contacting surface is a rough surface configured to be in the range of Rz=0 microns to 20 microns inside the press part and to recover to within the range of Rz=2 microns to 80 microns after exiting the press part.

The wet paper web transfer belt according to JP 06-057678 realizes to a high degree the adhesive and release properties of the wet paper web with the wet paper web contacting surface required to wet paper web transfer belts. Nevertheless, since different types of paper are made in the papermaking step, the basis weight of the paper naturally also differs. Therefore, the amount of moisture removed from the wet paper web during the pressing and the moisture content and amount of moisture of the wet paper web after pressing also differ. The moisture of the wet paper web after pressing has a big influence on the adhesive and release properties of the wet paper web in relation to the wet paper web contacting surface of the wet paper web transfer belt. From this point of view, the wet paper web transfer belt according to JP 06-057678 is not adequate for realizing the adhesive and release properties of the wet paper web for different types of paper (in particular paper of different basis weight).

Furthermore, US 2007/0074836 discloses a wet paper web transfer belt, characterized in that one of the alternative characteristics of wet paper web transfer belts such as surface roughness, bending strength, compressibility, recovery capacity can be continuously changed in the width direction of the wet paper web transfer belt in order to correspond to the papermaking machine specific profile.

SUMMARY

An object of the instant application is to provide a wet paper web transfer belt wherein the adhesive and release properties corresponding to the different types of paper of the papermaking step (in particular base paper of different basis weight) are realized, the passing of the wet paper web can be performed smoothly while the "paper robbing" phenomenon is prevented and the wet paper web transfer properties are improved.

Another object of the instant application is to provide a papermaking system having excellent production stability equipped with such a wet paper web transfer belt and a papermaking method having excellent production stability using the wet paper web transfer belt.

Still another object of the instant application is to provide a design method of a papermaking system wherein, in the press part, the adhesive and release properties corresponding to different types of paper (in particular base paper of different basis weight) are realized, and the passing of the wet paper web can be performed smoothly while the "paper robbing" phenomenon is prevented.

In their studies for solving the above-mentioned problems, the inventors of the instant application have found that, in a wet paper web transfer belt, the surface state of the resin layer surface contacting the wet paper web, (in other words the wet paper web contacting surface), has a big influence on improving the wet paper web transfer properties.

The inventors further found that, as far as the surface state of the wet paper web contacting surface of the wet paper web transfer belt is concerned, not only the surface roughness, but also the swelling rate of the resin layer constituting the wet paper web side surface with water has an influence on the adhesive and release properties of the wet paper web with the wet paper web transfer belt. It was also found that the surface state of the wet paper web contacting surface of a suitable wet paper web transfer belt can be changed depending on the type of wet paper web (in particular base paper of different basis weight.

Namely, the instant application is based on the following technology:

A wet paper web transfer belt for transferring a wet paper web including a wet paper web contacting surface for carrying the wet paper web. The wet paper web contacting surface is made of a resin layer. The wet paper web contacting surface includes a wet paper web carrying region for carrying the wet paper web, and the relations of equations (1) and (2) shown hereinafter are fulfilled.

$$Ra\ (\mu m)=0.0125\times X+A \quad (1)$$

$$A\leq B\times 10^{-16}\times Y^4+C\times 10^{-4}\times Y^3+D\times 10^{-2}\times Y^2+E\times Y+F \quad (2),$$

where:

Ra=arithmetic average surface roughness (μm) of the wet paper web contacting surface in the wet paper web carrying region, X=basis weight (g/m$^2$) of base paper to be produced from the wet paper web to be transferred, Y=swelling rate (%) of the resin constituting the resin layer with water,

B=4.441,

C=9.132,

D=−4.247,

E=0.6580, and

F=2.103, respectively.

In another embodiment is disclosed a design method of a papermaking system including a press part for squeezing water from a wet paper web and configured to pass the wet paper web in a closed draw by using a wet paper web transfer belt in at least one part of the press part. The wet paper web transfer belt includes a wet paper web contacting surface for carrying the wet paper web. The wet paper web contacting surface is made of a resin layer. The method includes a step for selecting the swelling rate of the resin layer with water depending on the basis weight of base paper to be produced from the wet paper web.

Advantages of the Instant Application

By adopting the above constitution, it is possible to provide a wet paper web transfer belt wherein the adhesive and release properties corresponding to the different types of paper of the papermaking step (in particular base paper of different basis weight) are realized and the passing of the wet paper web can be performed smoothly while the "paper robbing" phenomenon is prevented and the wet paper web transfer properties are improved.

It is further possible to provide a papermaking system having excellent production stability equipped with such a wet paper web transfer belt and a papermaking method having excellent production stability using the wet paper web transfer belt.

It is moreover possible to provide a design method of a papermaking system wherein, in the press part, the adhesive and release properties corresponding to different types of paper (in particular base paper of different basis weight) are realized, and the passing of the wet paper web can be performed smoothly while the "paper robbing" phenomenon is prevented.

DESCRIPTION OF EMBODIMENTS

Figure 1:
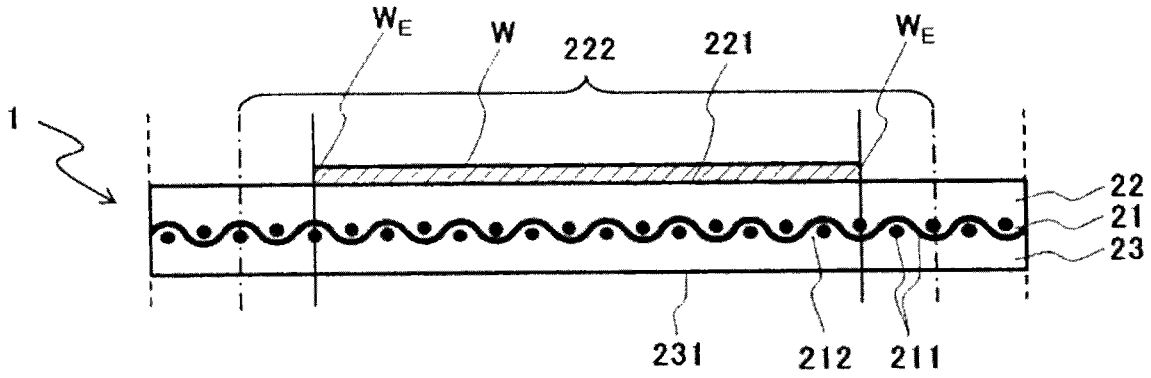
FIG. 1 is a cross-sectional view showing one example of a wet paper web transfer belt according to a preferred embodiment.

Hereinafter preferred embodiments of the wet paper web transfer belt, papermaking system, papermaking method and design method of a papermaking system according to the instant application will be described in detail by referring to the drawings.

Figure 2:
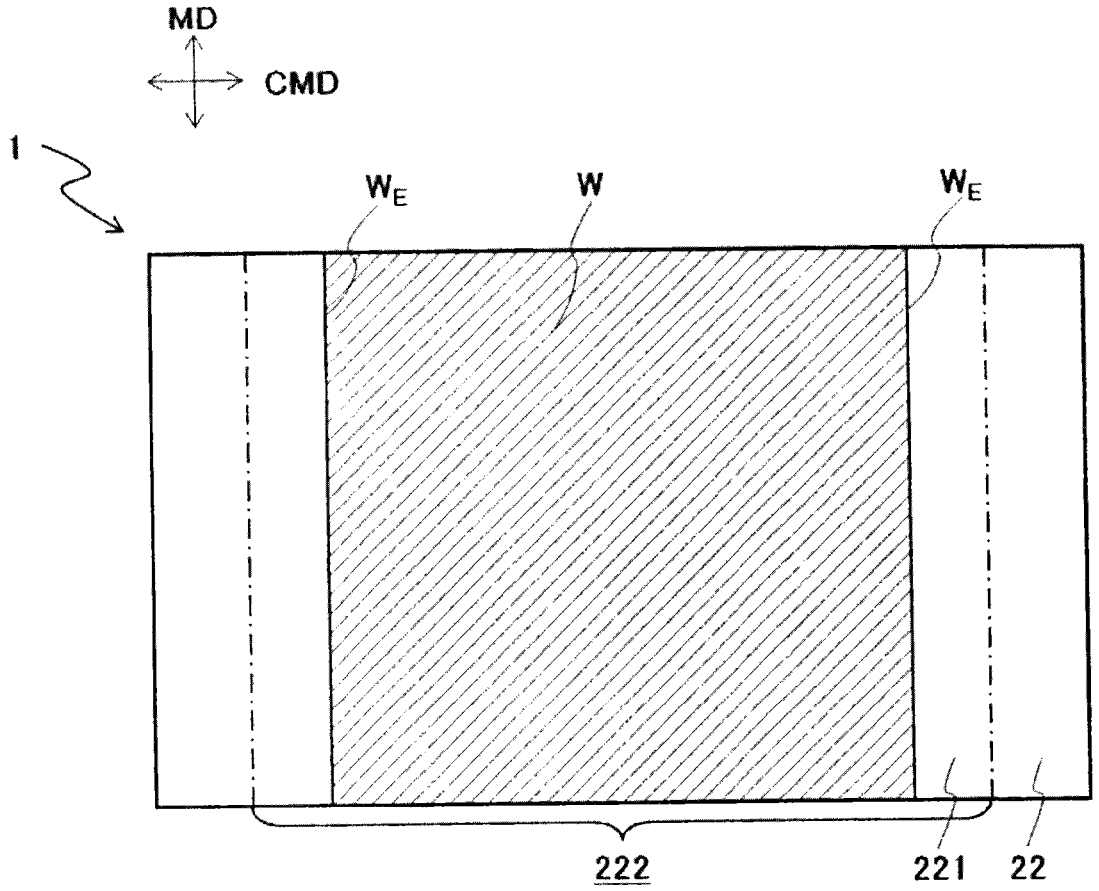
FIG. 2 is a plan view showing one example of a wet paper web transfer belt according to a preferred embodiment.

Firstly, a wet paper web transfer belt will be described. FIG. 1 is a cross-sectional view showing one example of a wet paper web transfer belt according to a preferred embodiment, and FIG. 2 is a plan view showing one example of a wet paper web transfer belt according to a preferred embodiment. It should be noted that, in FIGS. 1 and 2, a wet paper web W to be transferred is shown to facilitate understanding. However, it goes without saying that this is not the constitution of wet paper web transfer belt 1. Moreover, in the drawings, "MD" indicates the planned machine direction in the papermaking system and "CMD" indicates the planned cross machine direction in the papermaking system.

The wet paper web transfer belt 1 shown in FIGS. 1 and 2 is used for the transfer and passing of the wet paper web W in the press part of a papermaking machine. The wet paper web transfer belt 1 forms an endless band-shaped body. In other words, the wet paper web transfer belt 1 is an annular belt. Moreover, the longitudinal direction of the wet paper web transfer belt 1 is generally disposed along the machine direction (MD) of a papermaking system.

The wet paper web transfer belt 1 comprises a reinforcing fibrous substrate layer 21, a 1$^{st}$ resin layer (wet paper web contacting resin layer) 22 provided on one surface of the reinforcing fibrous substrate layer 21, and a 2$^{nd}$ resin layer (roll-side layer) 23 provided on the other surface of the reinforcing fibrous substrate layer 21; these layers are formed by laminating. Moreover, the 1$^{st}$ resin layer is the layer that forms the outer surface of the annular shape forming the wet paper web transfer belt 1.

The reinforcing fibrous substrate layer 21 is made of a reinforcing fibrous substrate 211, and a resin 212. The resin 212 is present in the reinforcing fibrous substrate layer 21 so as to fill the gaps of the fibers in the reinforcing fibrous substrate 211.

There are no particular limitations with regard to the reinforcing fibrous substrate 211, however, for example, fabrics woven by a weaving machine and the like from warp and weft yarns are commonly used. Moreover, it is also possible to use a grid-like web material of superimposed rows of warp and weft yarns without weaving.

The fineness of the fibers constituting the reinforcing fibrous substrate 211 is not particularly limited, for example, 300 to 10000 dtex, and preferably 500 to 6000 dtex may be used.

Moreover, the fineness of the fibers constituting the reinforcing fibrous substrate 211 may be different depending on the part in which the fibers are used. For example, the fineness of the warp and weft yarns in the reinforcing fibrous substrate 211 may be different.

As the reinforcing fibrous substrate 211, it is possible to use one or a combination of two or more of polyesters (polyethylene terephthalate, polybutylene terephthalate, and the like), aliphatic polyamides (polyamide 6, polyamide 11, polyamide 12, polyamide 612, and the like), aromatic polyamides (aramid), polyvinylidene fluoride, polypropylene, polyether ether ketone, polytetrafluoroethylene, polyethylene, wool, cotton, metals, and the like.

As the resin 212, it is possible to use one or a combination of two or more of thermosetting resins such as urethane, epoxy, acryl and the like, or thermoplastic resins such as polyamide, polyarylate, polyester, and the like. Preferably, urethane resin can be used.

The urethane resin used in the resin 212 is not particularly limited. However, for example, urethane resin obtained by curing a urethane prepolymer having a terminal isocyanate group obtained by reacting an aromatic or aliphatic polyisocyanate compound and polyol with a curing agent having an active hydrogen group may be used. Moreover, it is possible to use an anionic, nonionic or cationic aqueous urethane resin of the forced emulsification type or self-emulsification type. In this case, for improving the resistance to water, it is also possible to crosslink the aqueous urethane resin by using a cross linking agent of melamine, epoxy, isocyanate, carbodiimide and the like together with the aqueous urethane resin.

Moreover, the resin 212 may also comprise one type or a combination of two or more types of inorganic fillers such as titanium oxide, kaolin, clay, talc, diatomaceous earth, calcium carbonate, calcium silicate, magnesium silicate, silica, mica, and the like.

Further, the type and composition of the resin 212 in the reinforcing fibrous substrate layer 21 may be different in each part of the reinforcing fibrous substrate layer 21, or may be the same.

The $1^{st}$ resin layer 22 is provided on one surface of the reinforcing fibrous substrate layer 21 and is mainly made of a resin material (resin). The $1^{st}$ resin layer 22 constitutes a wet paper web contacting surface 221, which is in contact with the wet paper web W and carries the wet paper web W at the opposite side of the surface that is joined to the reinforcing fibrous substrate layer 21. In other words, the wet paper web transfer belt 1 carries the wet paper web W on the wet paper web contacting surface 221 of the $1^{st}$ resin layer 22 and can transfer the wet paper web W.

As shown in FIG. 2, the wet paper web contacting surface 221 comprises a wet paper web carrying region 222 for carrying the wet paper web W. The wet paper web carrying region 222 is centered on the center of the wet paper web W in the width direction, has a width which is greater than the width of the wet paper web W, and extends in the longitudinal direction (machine direction) of the wet paper web transfer belt 1.

The arithmetic average surface roughness Ra (μm) of the wet paper web contacting surface 221 in the wet paper web carrying region 222 simultaneously fulfills the relations of equations (1) and (2) hereinafter.

$$Ra\ (\mu m)=0.0125\times X+A \quad (1)$$

$$A\leq B\times 10^{-16}\times Y^4+C\times 10^{-4}\times Y^3+D\times 10^{-2}\times Y^2+E\times Y+F \quad (2),$$

(wherein the symbols are: Ra=arithmetic average surface roughness (μm) of the wet paper web contacting surface, X=basis weight (g/m$^2$) of the base paper to be produced from the wet paper web to be transferred, Y=swelling rate (%) of the resin constituting the resin layer with water, B=4.441, C=9.132, D=−4.247, E=0.6580, F=2.103, respectively).

By simultaneously fulfilling the relations of the above equations (1) and (2), the wet paper web adheres sufficiently to the wet paper web contacting surface 221 of the wet paper web transfer belt 1 and is reliably passed when the wet paper web W is passed from the felt to the wet paper web transfer belt 1.

As just described, the adhesiveness between the wet paper web W and the wet paper web contacting surface 221 varies not only depending on the surface roughness of the wet paper web contacting surface 221, but also depending on the swelling rate of the resin constituting the resin layer with water. Moreover, the surface state required of the wet paper web contacting surface 221 of the wet paper web transfer belt 1 differs depending on the base paper basis weight of the wet paper web W passing the press part. The inventors of the instant application found the facts as described above and found the relations of the equations (1) and (2) for the wet paper web transfer belt 1 to have excellent wet paper web transfer properties for different types of paper.

Moreover, the arithmetic average surface roughness Ra (μm) of the wet paper web contacting surface 221 in the wet paper web carrying region 222 is not particularly limited as long as the relations described above are fulfilled. However, it is preferred to simultaneously fulfill the relations of the equation (1) above and the equation (3) hereinafter.

$$B\times 10^{-16}\times Y^4+C\times 10^{-4}\times Y^3+D\times 10^{-2}\times Y^2+E\times Y+G\leq A \quad (3),$$

(wherein Y and A to E are the same as above and G=−0.3973).

By simultaneously fulfilling the relations of the above equations (1) and (3), the wet paper web W is easily released from the wet paper web contacting surface 221 of the wet paper web transfer belt 1 and is more reliably passed when the wet paper web W is passed from the wet paper web transfer belt 1 to the dryer fabric or the like.

Further, examples of the range of the constant A corresponding to the respective example of the swelling rate Y (%) are shown in Table 1.

TABLE 1

| Examples of swelling rate Y (%) of the resin | Range of constant A (equation (3) left side ≤ A ≤ (2) right side) |
|---|---|
| 1.5 | 0.50 ≤ A ≤ 3.00 |
| 3.0 | 1.22 ≤ A ≤ 3.72 |
| 5.0 | 1.92 ≤ A ≤ 4.45 |
| 7.5 | 2.53 ≤ A ≤ 5.03 |
| 10.0 | 2.85 ≤ A ≤ 5.35 |
| 15.0 | 3.00 ≤ A ≤ 5.50 |

In the present specification, the swelling rate (%) of the resin with water represents the weight change rate of the resin weight before it is immersed in warm water of 40° C. for 30 hours and after it was immersed in warm water of 40° C. for 30 hours and can be defined by the equation hereinafter.

Swelling rate (%)=(resin weight after swelling with water−resin weight before swelling with water)/(resin weight before swelling with water)×100 (%)

Further, the swelling rate of the resin was measured after moisture control by exposing the resin prior to immersion to an environment of a temperature of 20° C. and a relative humidity of 60%.

Moreover, in the instant application, the basis weight means the basis weight of paper measured according to JIS P 8124:2011 after moisture control.

Further, the above-mentioned Ra may be the roughness of a new wet paper web transfer belt 1 before it is installed in a papermaking machine, or it may be the roughness of a used wet paper web transfer belt 1 after it has been installed in a papermaking machine. As a result of this, the wet paper web transfer belt 1 can be used in a stable manner.

Moreover, the width of the wet paper web carrying region 222 is greater than the width of the wet paper web W, preferably it is 100 to 200% of the wet paper web W width, still more preferably it is 105 to 180% of the wet paper web W width. As just described, since the width of the wet paper web carrying region is greater than the width of the wet paper web W, the wet paper web W can be more reliably carried during operation. As a result of this, the excellent wet paper web transfer properties, as mentioned above, can be more reliably achieved.

Moreover, regarding the region outside the wet paper web carrying region 222, the width of this region and the surface roughness of the wet paper web contacting surface 221 in this region are not particularly limited.

As resin material constituting the $1^{st}$ resin layer 22, it is possible to use one type or a combination of two or more types of the resin materials that can be used in the reinforcing fibrous substrate layer 21, as described above. The type and composition of the resin material constituting the $1^{st}$ resin layer 22 and the resin constituting the reinforcing fibrous substrate layer 21 may be the same or may be different.

From the point of view of mechanical strength, wear resistance and flexibility, in particular urethane resins are preferred as resin material constituting the $1^{st}$ resin layer 22. Moreover, the $1^{st}$ resin layer 22 may also comprise one or more inorganic fillers in the same way as the reinforcing fibrous substrate layer 21. Further, the type and composition of the resin materials and the inorganic fillers in the $1^{st}$ resin layer 22 may be different in each part of the $1^{st}$ resin layer 22 or may be the same.

The $2^{nd}$ resin layer (roll-side layer) 23 is provided on one surface of the reinforcing fibrous substrate layer 21 and is mainly made of a resin material. The $2^{nd}$ resin layer 23 constitutes a roll contacting surface 231 for contacting a roll, described hereinafter, at the opposite side of the surface that is joined to the reinforcing fibrous substrate layer 21. For transferring the wet paper web, the wet paper web transfer belt 1 can be powered during use via a roll by bringing the roll contacting surface 231 in contact with a roll.

As resin material constituting the $2^{nd}$ resin layer 23, it is possible to use one type or a combination of two or more types of the resin materials that can be used in the reinforcing fibrous substrate layer 21, as described above. The type and composition of the resin material constituting the $2^{nd}$ resin layer 23 and the resin material constituting the $1^{st}$ resin layer 22 or the reinforcing fibrous substrate layer 21 may be the same or may be different.

From the point of view of mechanical strength, wear resistance and flexibility, in particular urethane resins are preferred as resin material constituting the $2^{nd}$ resin layer 23. Moreover, the $2^{nd}$ resin layer 23 may also comprise one or more inorganic fillers in the same way as the reinforcing fibrous substrate layer 21. Further, the type and composition of the resin materials and the inorganic fillers in the $2^{nd}$ resin layer 23 may be different in each part of the $2^{nd}$ resin layer 23 or may be the same.

The dimensions of the wet paper web transfer belt 1 described above are not particularly limited, as they may be suitably set depending on the use of the wet paper web transfer belt. The width of the wet paper web transfer belt 1 is not particularly limited, however, it may, for example, be 700 to 13,500 mm, or preferably 2,500 to 12,500 mm. The length of the wet paper web transfer belt 1 is not particularly limited, however, it may, for example, be 4 to 35 m, or preferably 10 to 30 m.

Moreover, the thickness of the wet paper web transfer belt 1 is not particularly limited, however, it may, for example, be 1.5 to 7.0 mm, or preferably 2.0 to 6.0 mm. Further, the thickness in different parts of the wet paper web transfer belt 1 may be different or may be the same. In this case, for example, the thickness of the edge parts' vicinity of the wet paper web transfer belt 1 may be smaller than the thickness in other parts. Since the edge parts' vicinity of the wet paper web transfer belt 1 is in contact with the roll edges during pressing, the load of the roll edges on the edge parts' vicinity of the wet paper web transfer belt 1 is reduced by adopting the above constitution.

Thus, according to the instant application, it is possible to provide a wet paper web transfer belt wherein the adhesive and release properties corresponding to the different types of paper of the papermaking step (in particular base paper of different basis weight) are realized, the passing of the wet paper web can be performed smoothly while the "paper robbing" phenomenon is prevented and the wet paper web transfer properties are improved.

Moreover, as a modified embodiment of the wet paper web transfer belt, an embodiment can, for example, be mentioned in which the wet paper web carrying region comprises a central region for carrying the center vicinity of the wet paper web and sheet edge regions for carrying the edge parts' vicinity of the wet paper web. The arithmetic average surface roughness of the wet paper web contacting surface in the sheet edge regions is smaller than the arithmetic average surface roughness of the wet paper web contacting surface in the central region. By thus reducing the surface roughness of the wet paper web contacting surface in the sheet edge regions, the wet paper web edge parts' vicinity can adhere to the wet paper web contacting surface. The result thereof is that the so-called "floating edges" phenomenon, in which the edge parts of the wet paper web are released from the wet paper web transfer belt during transfer, is prevented.

In this case, the arithmetic average surface roughness of the wet paper web contacting surface in the sheet edge regions is preferably 3.5 μm or less.

Moreover, as another modified embodiment of the wet paper web transfer belt, an embodiment can, for example, be mentioned in which the roll side layer is not a layer constituted by a resin material, but a batt fiber layer formed by needling a batt fiber. Further, as still another modified embodiment of the wet paper web transfer belt, an embodiment can, for example, be mentioned which comprises a layer in which the above-mentioned batt fibers are impregnated by resins as those mentioned above. In either embodiment, except for the roll side layer, the same constitution as in the above-mentioned wet paper web transfer belt 1 can be adopted.

Moreover, as batt fiber material, it is possible to use one type or a combination of two or more types of the materials that can be used in the reinforcing fibrous substrate layer 211.

Figure 3:
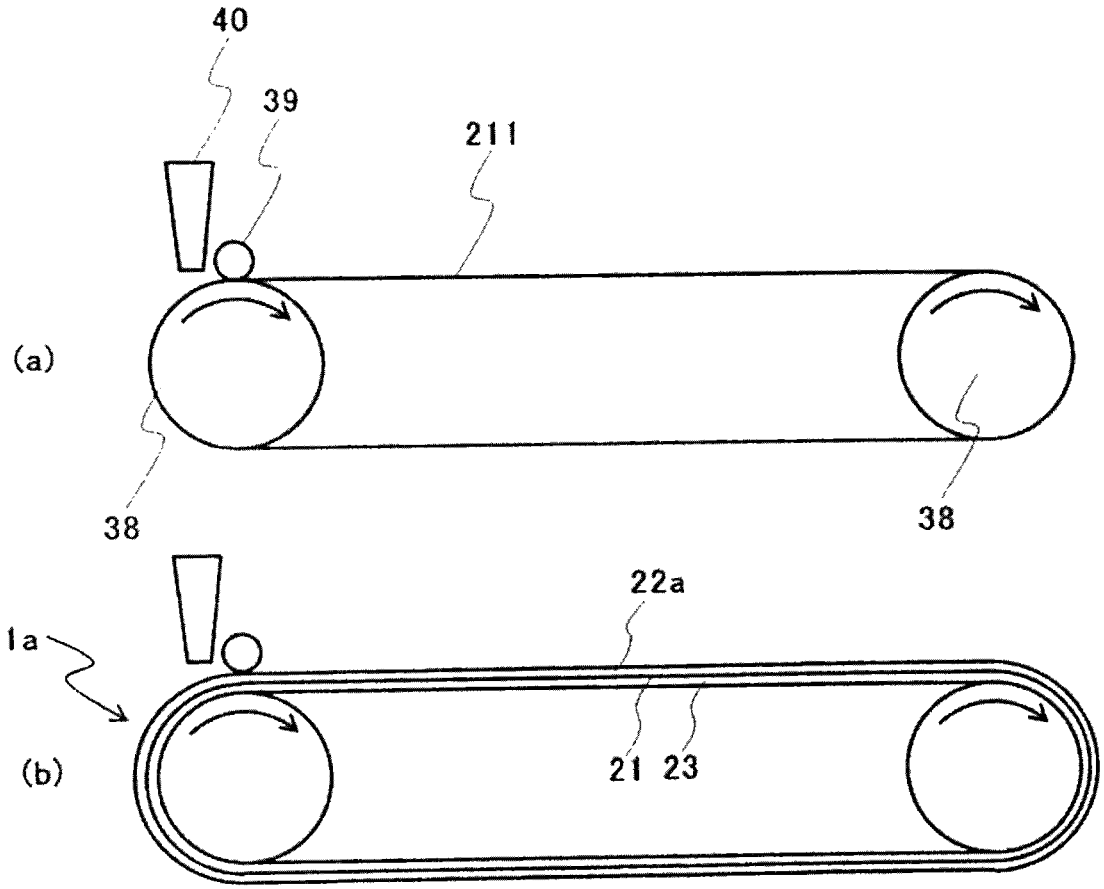
FIGS. 3(*a*) and 3(*b*) are schematic diagrams showing one example of the laminating step in a preferred embodiment of a production method of a wet paper web transfer belt.
Figure 4:
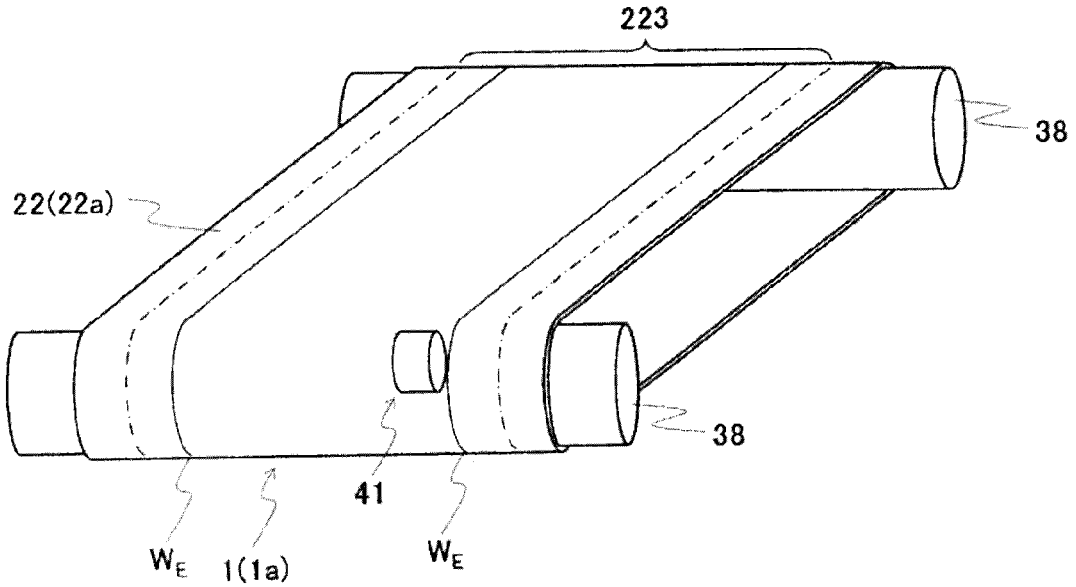
FIG. 4 is a schematic diagram showing one example of the 1$^{st}$ resin layer forming step in a preferred embodiment of a production method of a wet paper web transfer belt.

Next, one example of a preferred embodiment of a production method of the above-mentioned wet paper web transfer belts will be explained. FIGS. 3(*a*) and 3(*b*) are schematic diagrams showing one example of the laminating step in a preferred embodiment of a production method of a wet paper web transfer belt, and FIG. 4 is a schematic diagram showing one example of the $1^{st}$ resin layer forming step in a preferred embodiment of a production method of a wet paper web transfer belt.

The production method of the wet paper web transfer belt 1 according to the present embodiment comprises a step for forming an annular laminated body la comprising a $1^{st}$ resin layer precursor 22*a* as outermost layer (laminating step) and a step for forming the $1^{st}$ resin layer 22 by adjusting the surface roughness of the outer surface of the $1^{st}$ resin layer precursor 22*a* ($1^{st}$ resin layer forming step).

Firstly, in the laminating step, the annular and band-shaped laminated body la comprising the $1^{st}$ resin layer precursor 22*a* as outermost layer is formed. The laminated body 1*a* may be formed by any method, however, in the present embodiment, the reinforcing fibrous substrate layer 21 is formed, and, at the same time, the $1^{st}$ resin layer precursor 22*a* and a $2^{nd}$ resin layer 23 are formed on both sides of the reinforcing fibrous substrate layer 21 by coating a resin material on the reinforcing fibrous substrate 211 so that the resin material penetrates the reinforcing fibrous substrate 211. Specifically, as shown in FIG. 3(*a*), the annular and band-shaped reinforcing fibrous substrate 211 is installed so as to be in contact with two rolls 38 arranged in parallel.

Next, as shown in FIG. 3(*b*), a resin material is applied to the outer surface of the reinforcing fibrous substrate 211. The resin material may be applied by any method, however, in the present embodiment, the resin material is applied to the reinforcing fibrous substrate 211 by discharging the resin material from a resin discharge opening 40 while the rolls 38 rotate. Moreover, at the same time, the applied resin material is coated uniformly onto the reinforcing fibrous substrate 211 by using a coating bar 39. The resin material coated at this time can penetrate the reinforcing fibrous substrate 211. Therefore, in the present embodiment, it is possible to apply the resin comprised in the reinforcing fibrous substrate 211 and, at the same time, the resin material constituting the $1^{st}$ resin layer precursor 22*a* and the $2^{nd}$ resin layer 23.

Moreover, the resin material may also be applied as a mixture with the above-mentioned inorganic filler.

Moreover, the type and composition of the resin material and the inorganic filler for forming different parts of the different layers may be different or may be the same. By this means, it is, for example, possible to use a different surface roughness and swelling properties with water in each region of the wet paper web contacting surface 221 of the $1^{st}$ resin layer 22 that is being formed.

Next, the coated resin material is cured. By this means, the laminated body 1*a*, in which the layers are laminated from the outer surface in the order of the $1^{st}$ resin layer precursor 22*a*, the reinforcing fibrous substrate layer 21 and the $2^{nd}$ resin layer 23, is obtained. The method for curing the resin material is not particularly limited. However, the curing may, for example, be performed by heating, UV irradiation, and the like.

Moreover, in case the resin material is cured by heating, for example, a far infrared heater or other method may be used.

Further, in case the resin material is cured by heating, the heating temperature of the resin material is preferably 60 to 150° C., and still more preferably 90 to 140° C. Furthermore, the heating time can, for example, be 2 to 24 hours, and preferably 3 to 20 hours.

Next, in the $1^{st}$ resin layer forming step, the surface roughness of the outer surface of the $1^{st}$ resin layer precursor 22*a* is adjusted and the $1^{st}$ resin layer 22 comprising the wet paper web contacting surface 221 is formed. By this means, the wet paper web contacting surface 221 is formed and the wet paper web transfer belt 1 is obtained.

The surface roughness of the outer surface can, for example, be adjusted by polishing and/or buffing. Specifically, as shown in FIG. 4, this step is performed by bringing a polishing device 41 or buffing device (not shown in the drawing) into contact with the laminated body 1*a* as it is installed on the two rolls 38.

As a method and order of use of the polishing device 41 and the buffing device, for example, first, the entire outer surface of the $1^{st}$ resin layer precursor 22*a* is polished, and next, the outer surface corresponding to the wet paper web carrying region 222 is polished and/or buffed. By this means, the desired arithmetic average surface roughness of the wet paper web contacting surface 221 may be obtained.

Further, it is also possible not to polish and buff the outer surface corresponding to the edge parts' vicinity of the $1^{st}$ resin layer precursor 22*a*. Nevertheless, in consideration of the load applied by the roll edge, it is preferred to perform the machining so that the thickness of the edge parts' vicinity of the wet paper web transfer belt 1 is smaller than the thickness in other parts. Moreover, if the wet paper web contacting surface 221 of the wet paper web transfer belt 1 has the desired state before polishing and buffing, this step may be omitted.

Further, as a modified embodiment of the above-described production method of the wet paper web transfer belt 1, there is an embodiment in which, instead of the reinforcing fibrous substrate 211, a reinforcing fibrous substrate is used in which batt fibers are needled. By this means, it is possible to obtain a wet paper web transfer belt comprising a batt fiber layer as roll-side layer or a wet paper web transfer belt comprising a roll-side layer wherein the batt fiber layer is impregnated by a resin, as described above.

Figure 5:
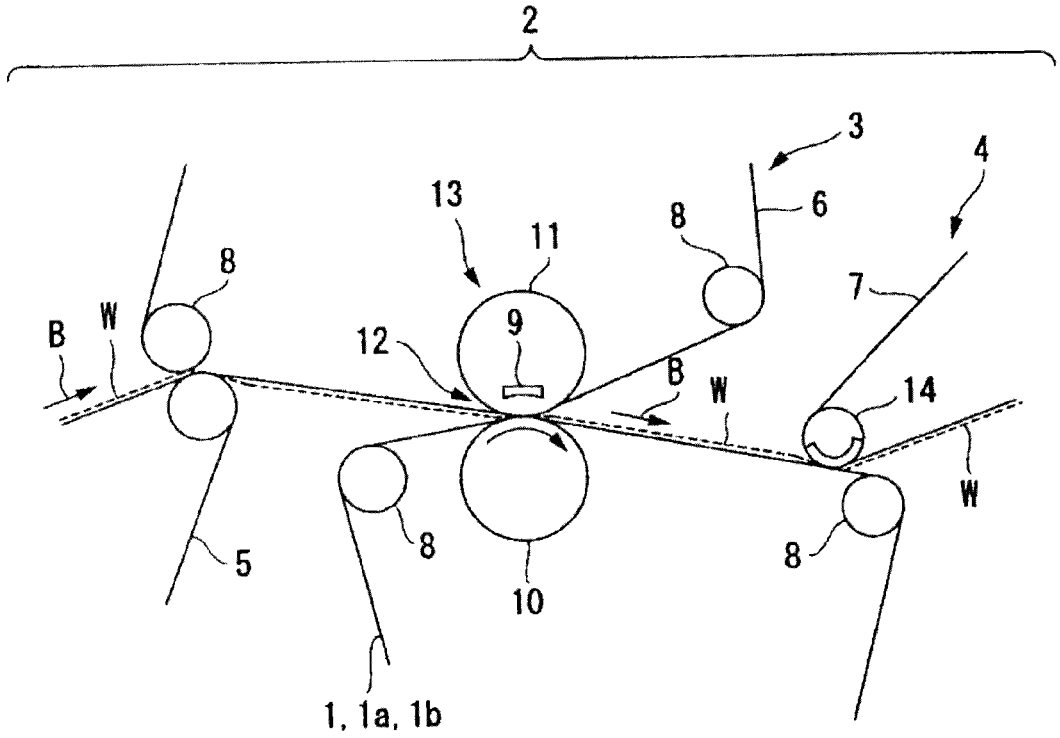
FIG. 5 is a schematic diagram showing one example of a part of the press part in a preferred embodiment of a papermaking system.

Next, a papermaking system will be described by referring to a preferred embodiment. FIG. 5 is a schematic diagram showing one example of a part of the press part in a preferred embodiment of a papermaking system according to the instant application. The papermaking system comprises a press part for squeezing water from a wet paper web; the press part is configured to pass, in at least one of its parts, a wet paper web in a closed draw by using the wet paper web transfer belt.

Moreover, in the present embodiment, a papermaking system 2 comprises a wire part (not shown in the drawing) for dewatering a pulp slurry and forming a wet paper web, a press part 3 for squeezing water from the wet paper web, and a dryer part 4 for drying the wet paper web from which water has been squeezed. The wire part, press part 3 and dryer part 4 are arranged along the transfer direction (arrow B direction) of the wet paper web in the order of these steps.

The wire part is configured to dewater pulp slurry supplied from a head box while it is carried and transferred by wires, and to form a wet paper web. The wet paper web formed is transferred to the press part 3. In the present embodiment, a wire part of a publicly known constitution can be used. Therefore, the detailed description is omitted.

Next, the press part 3 is configured so as to squeeze water from the wet paper web transferred from the wire part. In general, press parts are publicly known. Moreover, in the present embodiment, a publicly known constitution can be used for certain parts of the press part 3. Therefore, the detailed description of the publicly known parts of the constitution of press part 3 is omitted.

The press part 3 comprises a press felt (also simply referred to as felt) 5, a press felt 6, a wet paper web transfer belt 1, guide rollers 8 for guiding and rotating the press felts 5, 6 and the wet paper web transfer belt 1, and a press section 12. The press felt 5, the press felt 6 and the wet paper web transfer belt 1 are each a band-shaped body configured to form an endless shape and are supported by the guide rollers 8. The press felts 5, 6, the wet paper web transfer belt 1, and a dryer fabric 7, respectively, support and transfer the wet paper web W in the direction of the arrow B. At this time, the wet paper web W is passed from the press felt 5 to the press felt 6 and from the press felt 6 to the wet paper web transfer belt 1. The wet paper web W is passed through the press section 12 in a closed draw from the press felt 6 to the wet paper web transfer belt 1.

Hereinafter the press section 12 will be described. The press section 12 is a compression means constituted by a shoe press mechanism 13 and a press roll 10 arranged in a position facing the shoe press mechanism 13. The shoe press mechanism 13 comprises a concave shoe 9 facing the press roll 10 and a band-shaped shoe press belt 11 surrounding the shoe 9. Together with the press roll 10, the shoe 9 constitutes the press section 12 via the shoe press belt 11. In the press section 12, the wet paper web W is pressed by the shoe 9 via the shoe press belt 11 and the press roll 10 while being sandwiched between the press felt 6 and the wet paper web transfer belt 1. As a result thereof, moisture is squeezed from the wet paper web W. The press felt 6 is configured to have high water permeability, and the wet paper web transfer belt 1 is configured to have low water permeability. Therefore, in the press section 12, the moisture in the wet paper web W moves to the press felt 6. In this way, in the press part 3, water is squeezed from the wet paper web W and the surface of the wet paper web is smoothed.

Immediately after exiting the press section 12, the wet paper web W, the press felt 6, and the wet paper web transfer belt 1 swell in volume because they are suddenly released from pressure. Due to this swelling and because of the capillary action of the pulp fibers constituting the wet paper web W, the so-called "rewetting phenomenon" occurs in which part of the moisture in the press felt 6 moves to the wet paper web W. Nevertheless, since the water permeability of the wet paper web transfer belt 1 is low, the amount of moisture held inside it is small. Therefore, there is hardly any rewetting due to moisture moving from the wet paper web transfer belt 1 to the wet paper web W, and the wet paper web transfer belt 1 contributes to improving the smoothness of the wet paper web W.

For passing the wet paper web W in the press section 12 in such a manner, it is required of the wet paper web transfer belt 1 that, directly after exiting the press section 12, the wet paper web W is released from the press felt 6 and positively adheres to the wet paper web contacting surface 221 of the wet paper web transfer belt 1. In general, it is in such parts that the "paper robbing" phenomenon tends to occur. The "paper robbing" described here indicates a phenomenon, in case a common wet paper web transfer belt is used, in which the adhesiveness to the wet paper web contacting surface is weak and the wet paper web passing the press section remains on the press felt without being moved from the press felt to the wet paper web transfer belt. Nevertheless, as described above, since the wet paper web transfer belt 1 has the suitable degree of adhesiveness with the wet paper web in its wet paper web contacting surface 221, and because it has excellent wet paper web transfer properties, the "paper robbing" by the press felt 6 is prevented.

Moreover, the contacting surface of the press felt 6 with the wet paper web is configured to comprise batt fibers, and the batt fibers preferably fulfill the relation of equation (4) hereinafter $$0.15X \leq Z \leq 0.3 \leq X \quad (4),$$

(wherein the symbols are: X=basis weight (g/m$^2$) of the base paper to be produced from the wet paper web to be transferred, Z=fineness (dtex) of the batt fibers, respectively.) By this means, the wet paper web W is more easily released from the press felt 6 and is more reliably passed from the press felt 6 to the wet paper web transfer belt 1.

Moreover, the wet paper web, having passed the press section 12, is carried and transferred by the wet paper web transfer belt 1 and is passed in a closed draw from the wet paper web transfer belt 1 to the dryer fabric 7 of the dryer part 4. The suction roll 14 of the dryer part 4, provided to support the dryer fabric 7, releases the wet paper web W adhering to the wet paper web transfer belt 1 by suction and causes it to adhere to the surface of the dryer fabric 7. In particular, in case the above-mentioned equation (3) is fulfilled, the wet paper web transfer belt 1 has excellent wet paper web transfer properties and the suitable properties for releasing the wet paper web W from the wet paper web contacting surface 221. Therefore, in this case too, the "paper robbing" phenomenon is prevented when the wet paper web is passed.

The dryer part 4 is configured to dry the wet paper web W. In the present embodiment, a publicly known constitution can be used as dryer part 4, therefore, the detailed description is omitted. The wet paper web W is dried and becomes base paper by passing through the dryer part 4.

Thus, in the papermaking system, by using a wet paper web transfer belt with excellent wet paper web transfer properties, it is possible to suppress such phenomena as the "paper robbing" phenomenon and to improve production stability. In particular, by setting the surface state of the wet paper web contacting surface in consideration of the basis weight of the wet paper web to be transferred and the swelling rate with water of the resin layer constituting the wet paper web contacting surface of the wet paper web transfer belt used, it is possible to realize the above-described wet paper web transfer properties corresponding to different types of paper (in particular paper of different basis weight) of the papermaking step.

Next, a preferred embodiment of the design method of a papermaking system will be described. The design method of a papermaking system comprises a press part for squeezing water from a wet paper web and is configured to pass a wet paper web in a closed draw by using a wet paper web transfer belt in at least one part of the press part. The wet paper web transfer belt comprises a wet paper web contacting surface for carrying the wet paper web, the wet paper web contacting surface being made of a resin layer, and a step for selecting the swelling rate of the resin layer with water depending on the basis weight of the base paper to be produced from the wet paper web is included.

Moreover, in addition to a press part, a papermaking system generally comprises a wire part, a dryer part and other parts. These parts and their design methods are publicly known. Therefore, in the present specification, the characteristic constitution of the instant application will be primarily described while the description of the other parts will be omitted.

In the present embodiment, which is one embodiment of the instant application, as described above, the wet paper web transfer belt comprises a wet paper web contacting surface for carrying the wet paper web, said wet paper web contacting surface being made of a resin, and comprises a step for selecting the swelling rate of the before-mentioned resin layer with water depending on the basis weight of the base paper to be produced from the wet paper web. By this, it is possible to control the adhesive and release properties of the wet paper web transfer belt in relation to the web paper web, as a result of which, the wet paper web transfer properties can be improved. Thus, the inventors of the instant application found that the swelling properties with water of the resin constituting the wet paper web contacting surface are largely related to the adhesiveness of the wet paper web to the wet paper web contacting surface and further found that the adhesiveness of the wet paper web to the wet paper web contacting surface also varies depending on the basis weight of the base paper to be produced from the wet paper web.

Moreover, in the present embodiment, it is preferred that, in addition to the swelling rate of the above-mentioned resin layer with water, the surface roughness of the wet paper web contacting surface is selected depending on the basis weight of the base paper to be produced from the wet paper web. In other words, in the step described above, it is preferred to select the surface roughness of the wet paper web contacting surface and the swelling rate of the above-mentioned resin layer with water depending on the basis weight of the base paper to be produced from the wet paper web. By thus matching and selecting the surface roughness of the wet paper web contacting surface related to the adhesive and release properties of the wet paper web to the wet paper web transfer belt, it is possible to easily improve the wet paper web transfer properties of the wet paper web belt.

Specifically, it is preferred to select the surface roughness of the wet paper web contacting surface and the swelling rate of the resin layer with water so as to fulfill the relations of the above-mentioned equations (1) and (2). By this means, the wet paper web can adhere sufficiently to the wet paper web contacting surface of the wet paper web transfer belt when the wet paper web is passed from the felt to the wet paper web transfer belt, and the passing of the wet paper web will be performed with reliability.

Moreover, it is preferred to select the surface roughness of the wet paper web contacting surface and the swelling rate of the resin layer with water so as to fulfill the relations of the above-mentioned equations (1) and (3). By this means, the wet paper web is released easily from the wet paper web contacting surface of the wet paper web transfer belt when the wet paper web is passed from the wet paper web transfer belt to the dryer fabric or the like, and the passing of the wet paper web will be performed with greater reliability.

Thus, according to the instant application, it is possible to provide a design method of a papermaking system wherein, with regard to the press part, the adhesive and release properties of the wet paper web corresponding to different types of paper (in particular base paper of different basis weight) are realized, and the passing of the wet paper web can be performed smoothly while the "paper robbing" phenomenon is prevented.

Next, a papermaking method will be described by referring to a preferred embodiment. The papermaking method comprises a step in which water is squeezed from a wet paper web formed by dewatering a pulp slurry. In this step, the wet paper web is passed in a closed draw by using a wet paper web transfer belt.

Moreover, the papermaking method comprises a step for forming a wet paper web by dewatering a pulp slurry (dewatering step), a step for squeezing water from the wet paper web (water squeezing step), and a step for drying the wet paper web (drying step).

Further, the dewatering step and the drying step can each be performed by a publicly known method, therefore, the detailed description will be omitted. For example, the dewatering step and the drying step can be performed by using the above-mentioned wire part and dryer part 4, respectively.

In the water squeezing step, water is further squeezed from the wet paper web obtained in the dewatering step.

In the present embodiment, the wet paper web is passed in a closed draw by using the above-described wet paper web transfer belt in the water squeezing step. By using a wet paper web transfer belt having excellent wet paper web transfer properties, the "paper robbing" phenomenon is prevented. Moreover, by suitably using a wet paper web transfer belt matching the basis weight of the raw paper, it is possible to prevent such a "paper robbing" phenomenon for different types of paper. In particular, it is preferred to move the wet paper web in a closed draw from a felt to the wet paper web transfer belt. In this case, the above-mentioned "paper robbing" phenomenon is prevented with greater reliability.

Moreover, it is preferred that the batt fibers constituting the contacting surface of the above-mentioned felt with the wet paper web fulfill the relation of equation (4). In this case, problems such as the "paper robbing" described above can be prevented with greater reliability.

Moreover, the water squeezing step can be performed by using the press part 3 described above.

Thus, in the papermaking method described herein, by using a wet paper web transfer belt with excellent wet paper web transfer properties, it is possible to suppress such phenomena as the "paper robbing" phenomenon and to improve production stability. In particular, by setting the surface state of the wet paper web contacting surface in consideration of the basis weight of the wet paper web to be transferred and the swelling rate with water of the resin layer constituting the wet paper web contacting surface of the wet paper web transfer belt used, it is possible to realize the above-described wet paper web transfer properties corresponding to different types of paper (in particular paper of different basis weight) of the papermaking step.

Above, the instant application has been described in detail based on preferred embodiments, however, the instant application is not limited by this. Each constitution may be substituted as desired, or a constitution may be added as desired, as long as a similar function can be obtained.

EXAMPLES

Hereinafter, the instant application will be described even more specifically by means of the Examples. However, the instant application is not limited to these Examples.

1. Production of a Wet Paper Web Transfer Belt

Firstly, the wet paper web transfer belts of Examples 1 to 36 were produced according to the constitution hereinafter.

The Reinforcing Fibrous Substrate

The following constitution was used for the reinforcing fibrous substrate of the wet paper web transfer belts of Examples 1 to 36:

Upper warp yarn: twisted monofilament of 2000 dtex made from polyamide 6

Lower warp yarn: twisted monofilament of 2000 dtex made from polyamide 6

Weft yarn: twisted monofilament of 1400 dtex made from polyamide 6

Weave: double warp weave of 40 upper/lower warp yarns/5 cm and 40 weft yarns/5 cm The reinforcing fibrous substrate was made by entangling and integrating batt fibers of 20 dtex made from polyamide 6 with the woven fabric of the above constitution by needling 300 g/m$^2$ of the batt fibers to the roll side of the woven fabric.

The Resin Material

The resin material of the wet paper web transfer belt of Examples 1 to 6 and Examples 19 to 24 was obtained by reacting a mixture of tolylenediisocyanate (TDI) and polytetramethylene glycol (PTMG), as urethane prepolymer, with Dimethylthiotoluenediamine (DMTDA), as curing agent.

The resin material of the wet paper web transfer belts of Examples 7 to 12 and Examples 25 to 30 was obtained by reacting an anionic urethane dispersion with a melamine/formaldehyde cross-linking agent.

The resin material of the wet paper web transfer belts of Examples 13 to 18 and Examples 31 to 36 was obtained by reacting a mixture of a prepolymer mixed from tolylenediisocyanate (TDI) and polyethylene glycol and a prepolymer mixed from tolylenediisocyanate (TDI) and polytetramethylene glycol (PTMG), as urethane prepolymers, with Dimethylthiotoluenediamine (DMTDA), as curing agent.

Moreover, all of the resin materials are impermeable to water.

The Wet Paper Web Transfer Belt (Semi-Finished Product)

For the wet paper web transfer belts of Examples 1 to 36, the reinforcing fibrous substrate was impregnated with the above-mentioned water impermeable resin from its wet paper web contacting side to the center part of the woven fabric of the reinforcing fibrous substrate, and said water impermeable resin was laminated and cured to obtain the semi-finished product of the wet paper web transfer belt comprising a resin layer forming a wet paper web contacting surface at the wet paper web mounting surface side of the reinforcing fibrous substrate. Moreover, the length and width were 20 m and 900 mm, respectively.

The Polishing and Buffing

For polishing the wet paper web contacting surface of the wet paper web transfer belts of Examples 1 to 36, grit 80 to 600 polishing paper or cloth was suitably installed in a polishing device. Moreover, buffing was suitably performed for adjusting the surface roughness of the wet paper web contacting surface. In this way, the wet paper web transfer belts were completed.

The Swelling Rate of the Resin Material

The swelling rates in water of the resin material used in the Examples were as shown in Table 2 hereinafter.

2. Evaluation of the Transfer

Figure 6:
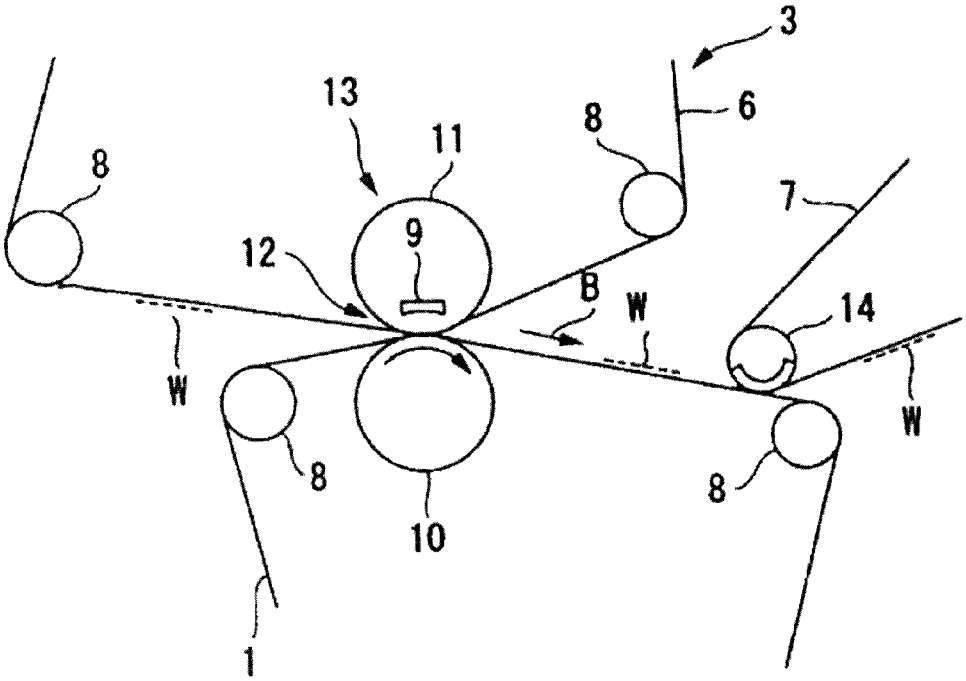
FIG. 6 is a schematic diagram showing a device for evaluating a wet paper web transfer belt.

The evaluation device of wet paper web transfer belts shown in FIG. 6 was used to evaluate the "paper robbing" due to the felt 6 or the wet paper web transfer belt after the wet paper web W had passed the press nip 12 under the conditions hereinafter. Further, the evaluation device shown in FIG. 6 is identical to the device in FIG. 5, except that the constitution upstream of the press felt 6 has been omitted from the constitution of the press part 3. Moreover, the pressing conditions, the constitution of the press felt 6 and the constitution of the wet paper web were as described hereinafter.

The Pressing Conditions

Papermaking speed: 1600 m/min

Pressing pressure: 1050 kN/m

The Constitution of the Press Felt 6

The constitution of the base fabric of the press felt 6 was identical in all Examples while the fineness of the batt fibers was changed depending on the basis weight of the raw material of the wet paper web.

Base fabric: laminated base fabric

Upper Fabric Base Fabric

Warp yarns: monofilament of 500 dtex made from polyamide 6

Weft yarns: monofilament of 1500 dtex made from polyamide 6

Weave: 3/1 broken weave of 40 warp yarns/5 cm and 90 weft yarns/5 cm

Lower Fabric Base Fabric

Warp yarns: twisted monofilament of 2000 dtex made from polyamide 6

Weft yarns: twisted monofilament of 1400 dtex made from polyamide 6

Weave: 3/1 broken weave of 40 warp yarns/5 cm and 40 weft yarns/5 cm

Batt Fiber Needled to the Base Fabric (For Base Paper with a Basis Weight of 30 g/m$^2$)

Front layer batt fiber: 200 g/m$^2$ batt fiber of 6 dtex made from polyamide 6

Center layer batt fiber: 400 g/m$^2$ batt fiber of 20 dtex made from polyamide 6

Rear layer batt fiber: 400 g/m$^2$ batt fiber of 20 dtex made from polyamide 6

(For Base Paper with a Basis Weight of 100 g/m$^2$)

Front layer batt fiber: 200 g/m$^2$ batt fiber of 20 dtex made from polyamide 6

Center layer batt fiber: 400 g/m$^2$ batt fiber of 20 dtex made from polyamide 6

Rear layer batt fiber: 400 g/m$^2$ batt fiber of 20 dtex made from polyamide 6

(For Base Paper with a Basis Weight of 200 g/m$^2$)

Front layer batt fiber: 200 g/m$^2$ batt fiber of 40 dtex made from polyamide 6

Center layer batt fiber: 400 g/m$^2$ batt fiber of 40 dtex made from polyamide 6

Rear layer batt fiber: 400 g/m$^2$ batt fiber of 40 dtex made from polyamide 6

Felt moisture: felt moisture weight/(felt moisture weight+felt weight per unit area)=adjusted to 30%

The Wet Paper Web (Handsheet)

Pulp: LBK 100% csf 300 mL

Basis weight: 30 g/m$^2$, 100 g/m$^2$, 200 g/m$^2$

Wet paper web moisture before pressing: wet paper web moisture weight before pressing/(wet paper web moisture weight before pressing+wet paper web bone dry weight)=adjusted to 60% (moisture control through a filter paper, wet paper web moisture after pressing about 50%)

Wet paper size: 700 mm length by 700 mm width

Further, the "paper robbing" by the felt 6 or the wet paper web transfer belt after passing the nip was evaluated with the help of a video camera.

The wet paper web transfer state was compared and evaluated for the wet paper web transfer belts of Examples 1 to 36. The properties, evaluation conditions and evaluation results of the wet paper web transfer belts are shown in Table 2. Further, the graphs in FIGS. 7(*a*), (*b*) and (*c*) show the relation between the surface roughness and the swelling rate of the wet paper web transfer belts of each Example under the condition, in which base paper of a basis weight of 30 g/m$^2$, 100 g/m$^2$ or 200 g/m$^2$, respectively.

Figure 7:
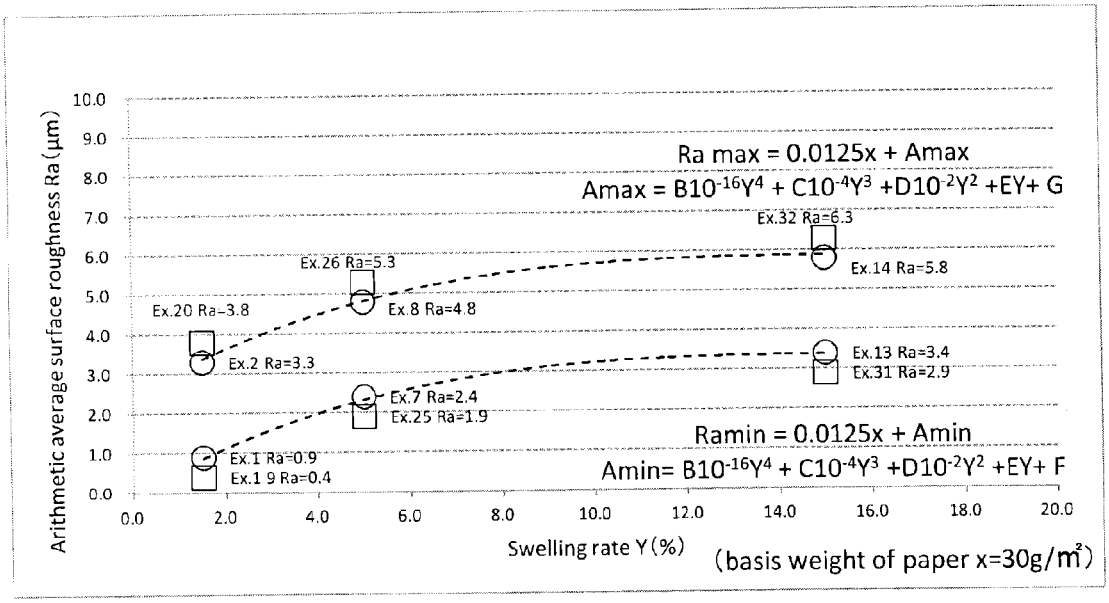
FIGS. 7(*a*) to (*c*) are graphs showing the relation between the swelling rate and the surface roughness of the wet paper web transfer belts of each example under the condition, in which base paper has a basis weight of (a) 30 g/m$^2$, (b) 100 g/m$^2$ or (c) 200 g/m$^2$, respectively.
Figure 7:
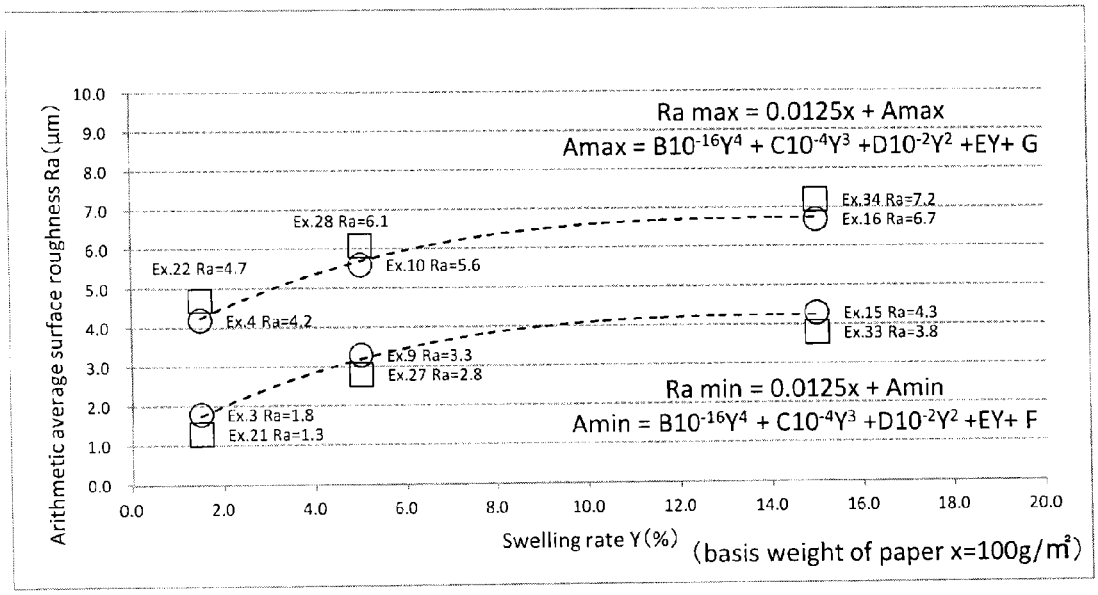
Figure 7:
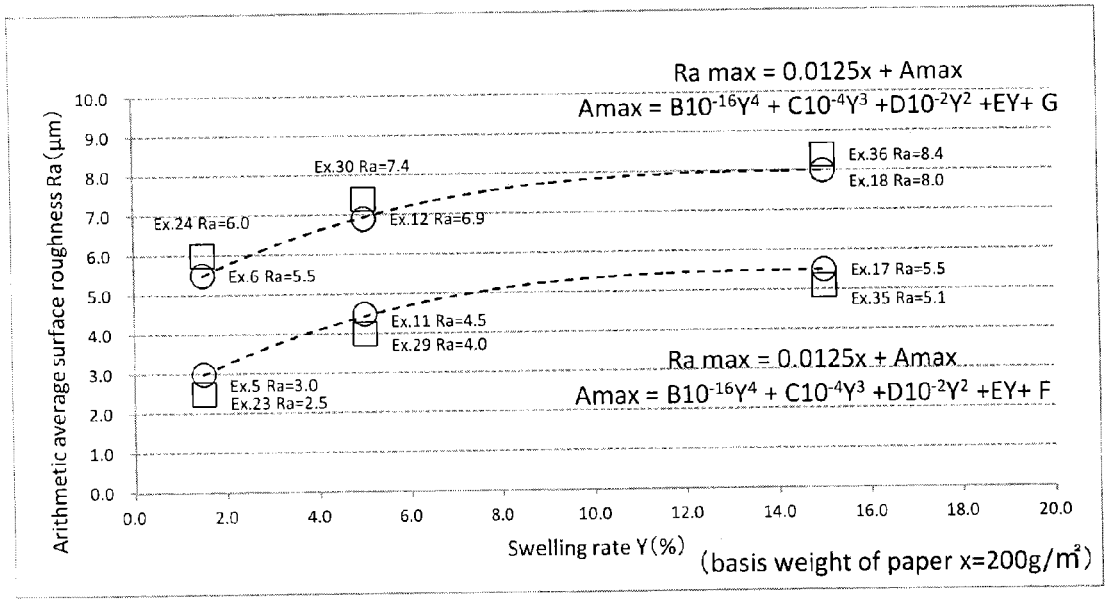

Further, in the graphs of FIG. 7, the dotted line corresponding to "Ramax" is the greatest arithmetic average surface roughness (μm) fulfilling the relations of equations (1) and (2) in the tests of the Examples; and the dotted line corresponding to "Ramin" is the smallest arithmetic average surface roughness (μm) fulfilling the relations of equations (1) and (3) in the tests of the Examples. As shown in FIG. 7, Examples 1 to 18 fulfill the relations of equations (1) to (3); Examples 19, 21, 23, 25, 27, 29, 31, 33, 35 fulfill the relations of equations (1) and (2), but not the relation of equation (3); the remaining Examples: 20, 22, 24, 26, 28, 30, 32, 34, 36 do not fulfill the relations of equations (1) and (2).

TABLE 2

| | Wet paper web transfer belt properties | | Evaluation condition | Evaluation item (evaluation result) | |
|---|---|---|---|---|---|
| Example | Swelling rate Y (%) | Roughness of the wet paper web contacting surface Ra (μm) | Basis weight of the base paper ($g/m^2$) | "Paper robbing" by the felt | "Paper robbing" by the wet paper web transfer belt |
| 1 | 1.5 | 0.9 | 30 | no | no |
| 2 | 1.5 | 3.3 | 30 | no | no |
| 3 | 1.5 | 1.8 | 100 | no | no |
| 4 | 1.5 | 4.2 | 100 | no | no |
| 5 | 1.5 | 3.0 | 200 | no | no |
| 6 | 1.5 | 5.5 | 200 | no | no |
| 7 | 5.0 | 2.4 | 30 | no | no |
| 8 | 5.0 | 4.8 | 30 | no | no |
| 9 | 5.0 | 3.3 | 100 | no | no |
| 10 | 5.0 | 5.6 | 100 | no | no |
| 11 | 5.0 | 4.5 | 200 | no | no |
| 12 | 5.0 | 6.9 | 200 | no | no |
| 13 | 15.0 | 3.4 | 30 | no | no |
| 14 | 15.0 | 5.8 | 30 | no | no |
| 15 | 15.0 | 4.3 | 100 | no | no |
| 16 | 15.0 | 6.7 | 100 | no | no |
| 17 | 15.0 | 5.5 | 200 | no | no |
| 18 | 15.0 | 8.0 | 200 | no | no |
| 19 | 1.5 | 0.4 | 30 | no | yes |
| 20 | 1.5 | 3.8 | 30 | yes | — |
| 21 | 1.5 | 1.3 | 100 | no | yes |
| 22 | 1.5 | 4.7 | 100 | yes | — |
| 23 | 1.5 | 2.5 | 200 | no | yes |
| 24 | 1.5 | 6.0 | 200 | yes | — |
| 25 | 5.0 | 1.9 | 30 | no | yes |
| 26 | 5.0 | 5.3 | 30 | yes | — |
| 27 | 5.0 | 2.8 | 100 | no | yes |
| 28 | 5.0 | 6.1 | 100 | yes | — |
| 29 | 5.0 | 4.0 | 200 | no | yes |
| 30 | 5.0 | 7.4 | 200 | yes | — |
| 31 | 15.0 | 2.9 | 30 | no | yes |
| 32 | 15.0 | 6.3 | 30 | yes | — |
| 33 | 15.0 | 3.8 | 100 | no | yes |
| 34 | 15.0 | 7.2 | 100 | yes | — |
| 35 | 15.0 | 5.1 | 200 | no | yes |
| 36 | 15.0 | 8.4 | 200 | yes | — |

As shown in Table 2, with the wet paper web transfer belts of Examples 1 to 19, 21, 23, 25, 27, 29, 31, 33, 35, which fulfill the relations of equations (1) and (2), the "paper robbing" due to the felt 6 was prevented. In particular, with the wet paper web transfer belts of Examples 1 to 18, which simultaneously fulfill the relations of equations (1) and (3), the move of the wet paper web from the wet paper web transfer belt to the dryer fabric was also smooth. Further, with respect to the wet paper web transfer belts with which there was "paper robbing" by the wet paper web transfer belt, it is possible to solve the problem of "paper robbing" due to the wet paper web transfer belt by increasing the suction force of the suction roll. However, this will apply an excessive load onto the wet paper web. Therefore, it was found that the wet paper web transfer belts of Examples 1 to 18, which also fulfill the relations of equations (1) and (3), had excellent wet paper web transfer properties without applying an excessive load onto the wet paper web. Moreover, from the above-mentioned results of the Examples, it was possible to confirm that the wet paper web transfer belts according to the instant application have good wet paper web transfer properties corresponding to wet paper webs of base paper with different basis weight.

On the other hand, for the wet paper web transfer belts of Examples 20, 22, 24, 26, 28, 30, 32, 34, 36, which do not fulfill the relations of equations (1) and (2), it was confirmed that the wet paper web transfer properties were poor as a result of the "paper robbing" phenomenon.

Moreover, it was shown that, by designing a papermaking system wherein the swelling rate of the resin layer constituting the wet paper web transfer belt with water is appropriately selected depending on the basis weight of the base paper to be produced from the wet paper web, it is possible to improve the transfer properties of the wet paper web inside the system. In particular, the control of the wet paper web transfer properties was easier when the above-mentioned swelling rate and surface roughness were taken into consideration.

The invention claimed is:

1. A papermaking system comprising a press part for squeezing water from a wet paper web, wherein the press part is configured to pass the wet paper web in a closed draw by using a wet paper web transfer belt, in at least one part thereof the wet paper web transfer belt comprising:

a surface to contact the wet paper web and to carry the wet paper web, said surface being made of a resin layer, wherein the surface includes a region to carry the wet paper web, and wherein relations of equations (1) and (2) are fulfilled, where $$Ra(\mu m)=0.0125\times X+A \quad (1), \text{ and}$$

$$A\leq B\times 10^{-16}\times Y^4+C\times 10^{-4}\times Y^3+D\times 10^{-2}\times Y^2+E\times Y+F \quad (2), \text{ and}$$

where:

Ra=arithmetic average surface roughness (μm) of the surface in the region to carry the wet paper web, X=basis weight ($g/m^2$) of a base paper to be produced from the wet paper web to be transferred, Y =swelling rate (%) of a resin constituting the resin layer with water in the range of 1.5-15.0%,
B=4.441,
C=9.132,
D=−4.247,
E=0.6580,
F=2.103,
respectively.

2. The papermaking system according to claim 1, wherein the press part is configured so that, at least in one part thereof, the wet paper web is conveyed in a closed draw from a felt to the wet paper web transfer belt,
wherein the contacting surface of the felt with the wet paper web is configured to comprise batt fibers, and
wherein the batt fibers fulfill a relation of equation (4), where $$0.15\,X \le Z \le 0.3\,X \quad (4), \text{and}$$

where
X=basis weight (g/m$^2$) of the base paper to be produced from the wet paper web to be transferred, and
Z=fineness (dtex) of the batt fibers,
respectively.

3. The paper making system of claim 1, wherein the wet paper web transfer belt fulfills relations of equation (3), where $$B\times10^{-16}Y^4+C\times10^{-4}\times Y^3+D\times10^{-2}\times Y^2+E\times Y+G\le A \quad (3), \text{and}$$

where:
Ra=arithmetic average surface roughness (μm) of the surface,
X=basis weight (g/m$^2$) of the base paper to be produced from the wet paper web to be transferred,
Y=swelling rate (%) of the resin constituting the resin layer with water,
B=4.441,
C=9.132,
D=−4.247,
E=0.6580, and
G=−0.3973,
respectively.

4. A papermaking method comprising a step for squeezing water from a wet paper web that has been formed by dewatering a pulp slurry,
wherein, in said step for squeezing water, the wet paper web is passed in a closed draw by using a wet paper web transfer belt, the wet paper web transfer belt comprising:
a surface to contact the wet paper web and to carry the wet paper web, said surface being made of a resin layer,
wherein the surface includes a region to carry the wet paper web, and
wherein relations of equations (1) and (2) are fulfilled, where $$Ra(\mu m)=0.0125\times X+A \quad (1), \text{and}$$

$$A\le B\times10^{-16}\times Y^4+C\times10^{-4}\times Y^3+D\times10^{-2}\times Y^2+E\times Y+F \quad (2), \text{and}$$

where:
Ra=arithmetic average surface roughness (μm) of the surface in the region to carry the wet paper web,
X=basis weight (g/m$^2$) of a base paper to be produced from the wet paper web to be transferred.,
Y=swelling rate (%) of a resin constituting the resin layer with water in the range of 1.5-15.0%,
B=4.441,
C=9.132,
D=−4.247,
E=0.6580,
F=2.103,
respectively.

5. The papermaking method according to claim 4, wherein, in the step for squeezing water, the wet paper web is conveyed in a closed draw from a felt to the wet paper web transfer belt,
wherein the contacting surface of the felt with the wet paper web includes batt fibers, and
wherein the batt fibers fulfill a relation of equation (4), where $$0.15X\le Z\le 0.3X \quad (4), \text{and}$$

where:
X=basis weight (g/m$^2$) of the base paper to be produced from the wet paper web to be transferred, and
Z=fineness (dtex) of the batt fibers,
respectively.

6. A design method of a papermaking system that includes a press part for squeezing water from a wet paper web, the papermaking system being configured to pass the wet paper web in a closed draw by using a wet paper web transfer belt in at least one part of the press part, the wet paper web transfer belt including a wet paper web contacting surface for carrying the wet paper web, and the wet paper web contacting surface being made of a resin layer, the design method comprising:
selecting a swelling rate of the resin layer with water depending on a basis weight of a base paper to be produced from the wet paper web.

7. The design method according to claim 6, wherein, in the selecting step, a surface roughness of the wet paper web contacting surface and the swelling rate of the resin layer with water are selected depending on the basis weight of the base paper to be produced from the wet paper web.

8. The design method according to claim 6, wherein, in the selecting step, a surface roughness of the wet paper web contacting surface and the swelling rate of the resin layer with water are selected depending on the basis weight of the base paper to be produced from the wet paper web so as to fulfill relations of equations (1) and (2), where $$Ra(\mu m)=0.0125\times X+A \quad (1), \text{and}$$

$$A\le B\times10^{-16}\times Y^4+C\times10^{-4}\times Y^3+D\times10^{-2}\times Y^2+E\times Y+F \quad (2), \text{and}$$

where:
Ra=arithmetic average surface roughness (μm) of the wet paper web contacting surface ,
X=basis weight (g/m$^2$) of the base paper to be produced from the wet paper web to be transferred,
Y=swelling rate (%) of the resin constituting the resin layer with water,
B=4.441,
C=9.132,
D=−4.247,
E=0.6580, and
F=2.103,
respectively.

9. The design method of a papermaking system according to claim 6, wherein, in the selecting step, the surface roughness of the wet paper web contacting surface and the swelling rate of the resin layer with water are selected depending on the basis weight of the base paper to be produced from the wet paper web so as to fulfill the relations of equations (1) and (3), where $$Ra(\mu m)=0.0125\times X+A \quad (1), \text{and}$$

$$B\times10^{-16}\times Y^4+C\times10^{-4}\times Y^3+D\times10^{-2}\times Y^2+E\times Y+G\le A \quad (3), \text{and}$$

where:
Ra=arithmetic average surface roughness (μm) of the wet paper web contacting surface, X=basis weight (g/m$^2$) of the base paper to be produced from the wet paper web to be transferred, Y=swelling rate (%) of the resin constituting the resin layer with water,

B=4.441,

C=9.132,

D=−4.247,

E=0.6580, and

G=−0.3973, respectively.

10. A method of producing a wet paper web transfer belt, comprising the steps of:

installing a reinforcing fibrous substrate as to be in contact with two rolls arranged in parallel;

applying a resin material to form a resin layer on an outer surface of the reinforcing fibrous substrate by discharging the resin material from a resin discharge opening while the rolls rotate;

curing the resin layer coated on the reinforcing fibrous substrate;

polishing an outer surface of the resin layer, the outer surface being configured to contact a wet paper web and to carry the wet paper web, wherein relations of equations (1) and (2) are fulfilled, where $$Ra(\mu m)=0.0125\times X+A \quad (1), \text{ and}$$

$$A\leq B\times 10^{-16}\times Y^4+C\times 10^{-4}\times Y^3+D\times 10^{-2}\times Y^2+E\times Y+F \quad (2), \text{ and}$$

where:

Ra=arithmetic average surface roughness (μm) of the outer surface in a region to carry the wet paper web, X=basis weight (g/m$^2$) of a base paper to be produced from the wet paper web to be transferred, Y=swelling rate (%) of the resin constituting the resin layer with water,

B=4.441,

C=9.132,

D=−4.247,

E=0.6580,

F=2.103, respectively.

11. The method of producing a wet paper web transfer belt according to claim 10, wherein relations of equation (3) are further fulfilled, where $$B\times 10^{-16}Y^4+C\times 10^{-4}\times Y^3+D\times 10^{-2}\times Y^2+E\times Y+G\leq A \quad (3), \text{and}$$

where:

Ra=arithmetic average surface roughness (μm) of the surface,

X=basis weight (g/m$^2$) of the base paper to be produced from the wet paper web to be transferred, Y=swelling rate (%) of the resin constituting the resin layer with water,

B=4.441,

C=9.132,

D=−4.247,

E=0.6580, and

G=−0.3973, respectively.

12. The method of producing a wet paper web transfer belt according to claim 10, wherein, the resin material is coating uniformly onto the reinforcing fibrous substrate by using a coating bar.

* * * * *